US007429310B2

(12) United States Patent
Heikkilä et al.

(10) Patent No.: US 7,429,310 B2
(45) Date of Patent: Sep. 30, 2008

(54) METHOD, ARRANGEMENT AND EQUIPMENT FOR TENSIONING AND GUIDING A FABRIC IN A PAPER OR BOARD MACHINE

(75) Inventors: Pertti K. Heikkilä, Laukaa (FI); Erkki Kärkkäinen, Karhula (FI); Erkka Nieminen, Tampere (FI); Samppa J. Salminen, Jyväskylä (FI); Veli-Matti Vainio, Tampere (FI)

(73) Assignee: Metso Paper, Inc., Helsinki (FI)

( * ) Notice: Subject to any disclaimer, the term of this patent is extended or adjusted under 35 U.S.C. 154(b) by 411 days.

(21) Appl. No.: 10/555,525

(22) PCT Filed: May 4, 2004

(86) PCT No.: PCT/FI2004/050055

§ 371 (c)(1),
(2), (4) Date: Nov. 3, 2005

(87) PCT Pub. No.: WO2004/099493

PCT Pub. Date: Nov. 18, 2004

(65) Prior Publication Data

US 2006/0249271 A1 Nov. 9, 2006

(30) Foreign Application Priority Data

May 5, 2003 (FI) ..... 20035059

(51) Int. Cl.
*D21F 11/00* (2006.01)

(52) U.S. Cl. ..... 162/197; 162/273; 162/272; 162/274; 162/199; 226/21; 226/22; 226/23; 226/170

(58) Field of Classification Search ..... 162/197, 162/273, 272, 274, 199, 289, 300; 226/21, 226/22, 23, 170, 174
See application file for complete search history.

(56) References Cited

U.S. PATENT DOCUMENTS

| | | | | |
|---|---|---|---|---|
| 5,403,447 | A | 4/1995 | Järvinen et al. | |
| 5,500,090 | A | 3/1996 | Autio | |
| 5,554,262 | A * | 9/1996 | Turner | 162/198 |
| 6,325,895 | B1 | 12/2001 | Graf | |

FOREIGN PATENT DOCUMENTS

| | | |
|---|---|---|
| EP | 0 519 398 | 6/1992 |
| EP | 0 519 398 A1 | 6/1992 |
| FI | 84504 | 8/1991 |

(Continued)

OTHER PUBLICATIONS

International Search Report issued in PCT/FI2004/050055.

*Primary Examiner*—Mark Halpern
(74) *Attorney, Agent, or Firm*—Stiennon & Stiennon

(57) ABSTRACT

A paper or board machine has a fabric (10) that is adapted mobile as well as rolls (11, 11') arranged to support the fabric (10). The fabric (10) is tensioned by changing the position of one roll (11') of the rolls (11, 11'). Correspondingly, the fabric (10) is guided by changing the alignment of one roll (11') of the said rolls (11, 11'). Surprisingly the fabric (10) is both tensioned and guided by changing the alignment and position of only one and the same roll (11'). In addition, the wrap angle of the fabric (10) at this roll (11') is set higher than 30°.

17 Claims, 5 Drawing Sheets

FOREIGN PATENT DOCUMENTS

| | | | |
|---|---|---|---|
| FI | 84504 | B | 8/1991 |
| FI | 113384 | | 4/2004 |
| FI | 113384 | B | 4/2004 |
| WO | WO 2004/099493 | | 5/2004 |
| WO | WO 2004/099493 | A1 | 5/2004 |

* cited by examiner

METHOD, ARRANGEMENT AND EQUIPMENT FOR TENSIONING AND GUIDING A FABRIC IN A PAPER OR BOARD MACHINE

CROSS REFERENCES TO RELATED APPLICATIONS

This application is a national stage application of International App. No. PCT/FI2004/050055, filed May 4, 2004, the disclosure of which is incorporated by reference herein, and claims priority on Finnish Application No. 20035059, Filed May 5, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to a method for tensioning and guiding a fabric in a paper or board machine, which includes a fabric that is adapted to be mobile and arranged as an endless loop, and rolls arranged to support the fabric, and in which method the fabric is tensioned by changing the position of both ends of one roll of the said rolls in relation to the fabric without changing the roll alignment in relation to the fabric, and the fabric wrap angle on the roll concerned is set higher than 30°, and the fabric is guided by changing the alignment of one roll of the said rolls in relation to the fabric by changing the position of one roll end in relation to the fabric at one level without changing the position of the other roll end. The invention also relates to a corresponding arrangement and equipment for tensioning and guiding a fabric in a paper or board machine.

Tensioning and guiding a fabric in a paper or board machine is described for example in Finnish patents Nos. 100412 (corresponding U.S. Pat. No. 5,403,447) and 94781 (corresponding U.S. Pat. No. 5,500,090). These patents describe tensioning and guiding of both a press felt and a dryer fabric. The press felt is separately described, as it is used in a specific manner. During the use depressions are formed in the press felt, which depressions have a tendency to grow and will cause vibrations in the press, and thereby new depressions. To avoid the problem it is attempted to stretch the fabric to an oblique direction. For detecting the obliquity, the press felt is provided with a guide strip, by the alignment of which the prevailing alignment of the press felt can be determined. The seam of the press felt, i.e. the orientation stripe, can also serve as the guide strip. A specific guide strip is used to facilitate its detection, as it is attempted to make the seaming point as invisible as possible in order to standardize the pressing event. By squaring the felt, possible depressions will form in the press felt irregularly and in different positions, which helps avoid strong vibrations and the multiplication of depressions. At the same time the press felt life also normally increases. Thus, turning the guide strip corresponds to squaring the felt.

The guide strip is turned in a known manner by moving one end of one roll supporting the press felt. Normally a tensioning device is also attached to this roll for tensioning the press felt. By shifting one end of the roll only, i.e. by changing the roll alignment, the travel distances of the press felt edges are different, in which case the press felt slightly stretches and settles in an oblique position. At the same time the press felt tends to move away from above the rolls in the lateral direction. To avoid this the alignment of the other roll supporting the press felt is additionally changed. Normally the guiding equipment is adapted at one end of a so-called guide roll. By means of the guiding equipment a counter force annulling the lateral force generated by turning of the guide strip is provided in the press felt, and this counter force then keeps the press felt essentially in place in its lateral direction. The previously mentioned patents describe automatic systems, which are used to automatically turn the guide strip based on vibrations, for example. Normally the dryer fabric is also equipped with similar tensioning and guiding equipment, although the dryer fabric lacks the guide strip, and a guide strip turning at the dryer fabric is most often not needed.

The proposed systems are functional as such, but they include several separate components. In addition, it is necessary to guide the fabric via several rolls, which requires a lot of installation space and increases the total fabric length. In this case the positioning of the components is often a big problem. Separate components also require a mutual control in order to function properly. In addition, the control devices are located far away from each other, in which case great forces are required for the control. Also, the distance between the control devices is long. In this case the fabric travels in an oblique position between the rolls to be controlled. In spite of automated systems there is a delay in turning the guide strip and guiding the fabric, which appears as lateral swinging of the fabric. Swinging is increased also by the approximate operation and poor controllability of the control devices. In other words, control movements are often excessive, and consequently the system attempts to correct a performed control with an opposite control. Furthermore, according to a general practice the fabric wrap angle is kept intentionally small on the actual guide roll.

SUMMARY OF THE INVENTION

The object of this invention is to provide a novel method for tensioning and guiding a fabric in a paper or board machine, the method being simpler than heretofore and avoiding the drawbacks of the prior art technique. The object of the invention is also to provide a novel arrangement for tensioning and guiding a fabric in a paper or board machine, requiring less installation space than heretofore and including less components than before. A further object of the invention is to provide novel equipment for tensioning and guiding a fabric in a paper or board machine, the equipment being compact in structure and versatile for its characteristics. In the method according to the invention the fabric is tensioned and guided surprisingly with one roll only. This provides a simple and accurate method for tensioning and guiding the fabric. In addition, the fabric is guided in a completely new way compared to the known method, in which the required control effect is provided with smaller movements than conventionally. Correspondingly, the arrangement according to the invention is simple, and the equipment used in it is compact and easy to control. In addition, the forces required are smaller than known, which further reduces the equipment size. Using the arrangement and equipment the fabric run can be simplified, which at the same time creates new freedom for the design of a paper or board machine. In known paper and board machines there are several fabrics and guiding devices for them, which can be replaced with the equipment according to the invention. This allows making remarkable savings in the acquisition and operating costs.

The invention is described below in detail by making reference to the enclosed drawings, which illustrate some of the embodiments of the invention, in which

DESCRIPTION OF THE PREFERRED EMBODIMENTS

Figure 1:
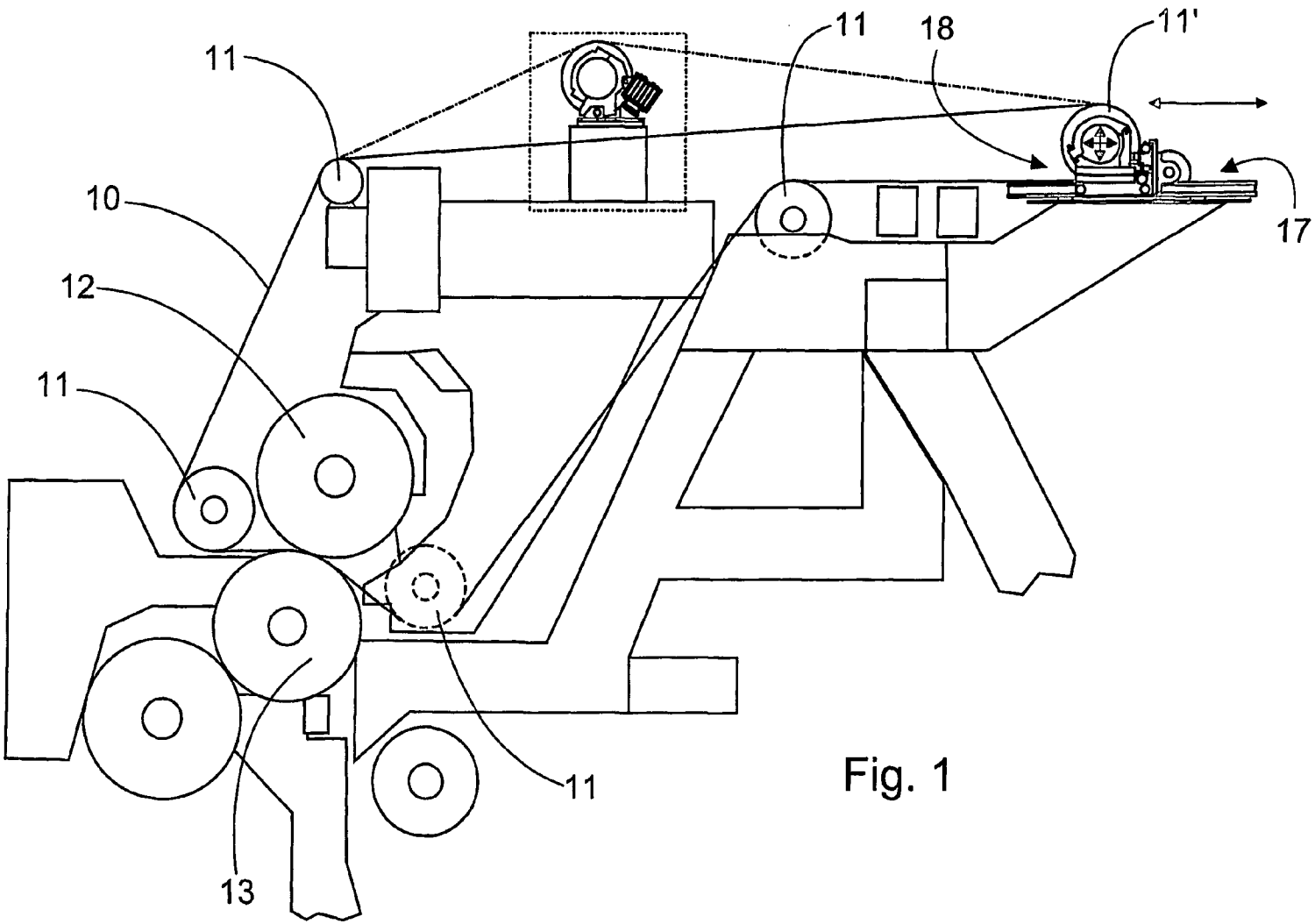
FIG. 1 shows a part of a paper machine press section provided with equipment according to the arrangement of the invention illustrating also a device according to the known technique.

FIG. 1 shows the arrangement according to the invention in a press section of a paper machine. The arrangement can as well be applied in connection with a board machine or another similar web forming machine. The arrangement is designed for tensioning and guiding a fabric in a paper or board machine. Fabrics comprise, in addition to the above mentioned press felt and dryer fabric, for example various transfer belts. Generally a paper machine includes a fabric that is adapted as a mobile and endless loop. The fabric is at least partly in contact with the web and its main purpose is to support and transfer the web. On the other hand, particularly the press felt also absorbs a lot of water in connection with the pressing event. In addition, a paper machine includes rolls, arranged to support the fabric, which are supported to the paper machine in a manner known as such. The paper machine also has tensioning equipment for tensioning the fabric by changing the position of one roll of the said rolls. Correspondingly, there is also guiding equipment for guiding the fabric by changing the alignment of one roll of the said rolls. That is, the fabric is tensioned by changing the position of one roll of the said rolls and the fabric is guided by changing the alignment of one roll of the said rolls. In other words, tensioning changes the position of both roll ends in relation to the fabric without changing the roll alignment in relation to the fabric. In practice, both ends are moved to the same extent and to the same direction. Correspondingly, guiding changes the position of one roll end in relation to the fabric at one level without changing the position of the other roll end.

According to the invention, the tensioning equipment and the guiding equipment are surprisingly adapted in connection with one and the same roll. Then the fabric is both tensioned and guided by changing the alignment and position of this roll in relation to the fabric. The roll movement directions are described in greater detail in connection with FIGS. 3*a-c*. In addition, the rolls are so arranged that the fabric wrap angle at the roll concerned is more than 30°. In this way, using the method according to the invention, the fabric can be guided in a simple and accurate manner. In addition, the equipment according to the arrangement of the invention is compact and can provide the required guiding forces with small movements. Also, for the positioning of the equipment there is more freedom than heretofore.

Figure 5A:
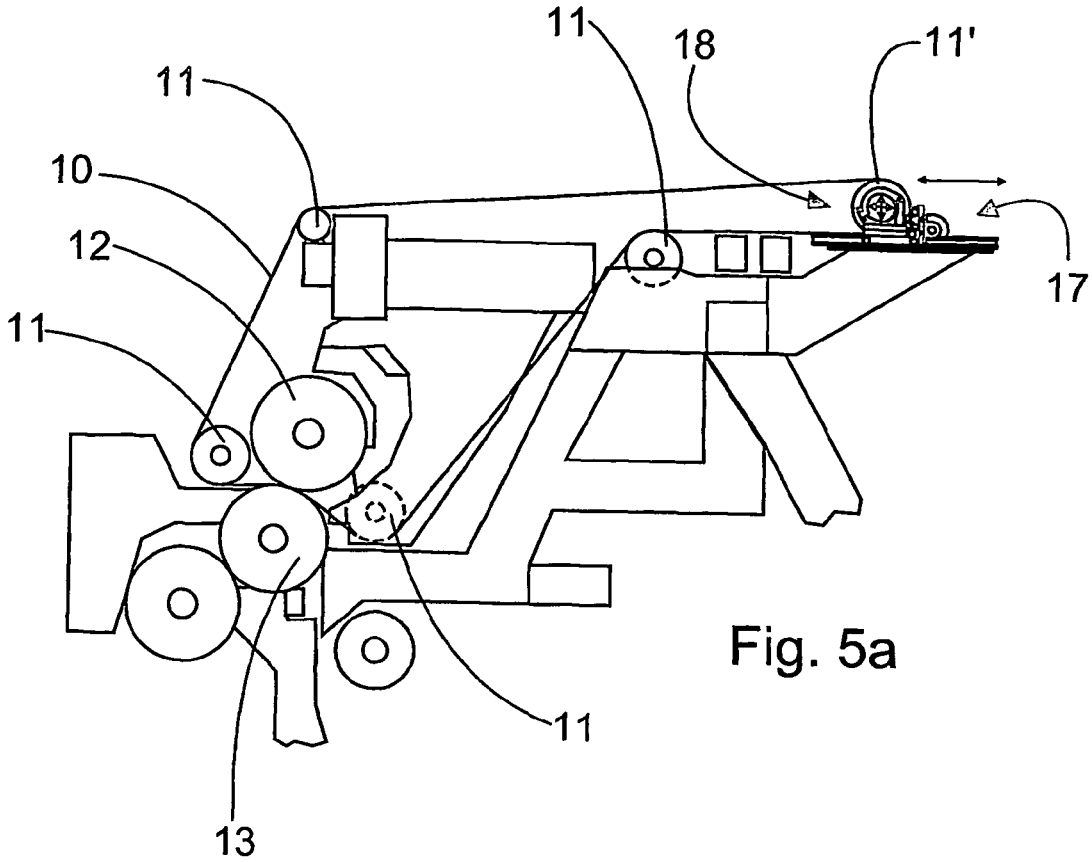
FIG. 5*a* shows the application of FIG. 1 without the device according to the known technique.

In FIG. 1 the press felt functioning as fabric 10 is supported with five rolls 11 and 11', for which according to the invention, the alignment and position of only one roll 11' is changed for tensioning and guiding the press felt. Here the press felt also runs through a press nip formed by two press rolls 12 and 13. In this way the web (not shown) remains in contact with the press felt only for a short time. The known press sections have several nips, through each of which two press felts normally run. In this case, using the equipment according to the invention, two to six rolls plus the related control equipment are saved solely in the press section. On the other hand, a paper machine has today as many as 20 guidable fabrics, which means that the total saving will be significant. In FIG. 1 the press felt is illustrated with a continuous line. Correspondingly, the travel route of a press felt according to the prior art technique is illustrated with a dot-and-dash line. The guide roll within the rectangle defined with the dot-and-dash line is also redundant due to the equipment according to the invention. This kind of application is shown in FIG. 5*a*. Identical reference numbers are used for functional parts.

Figure 2:
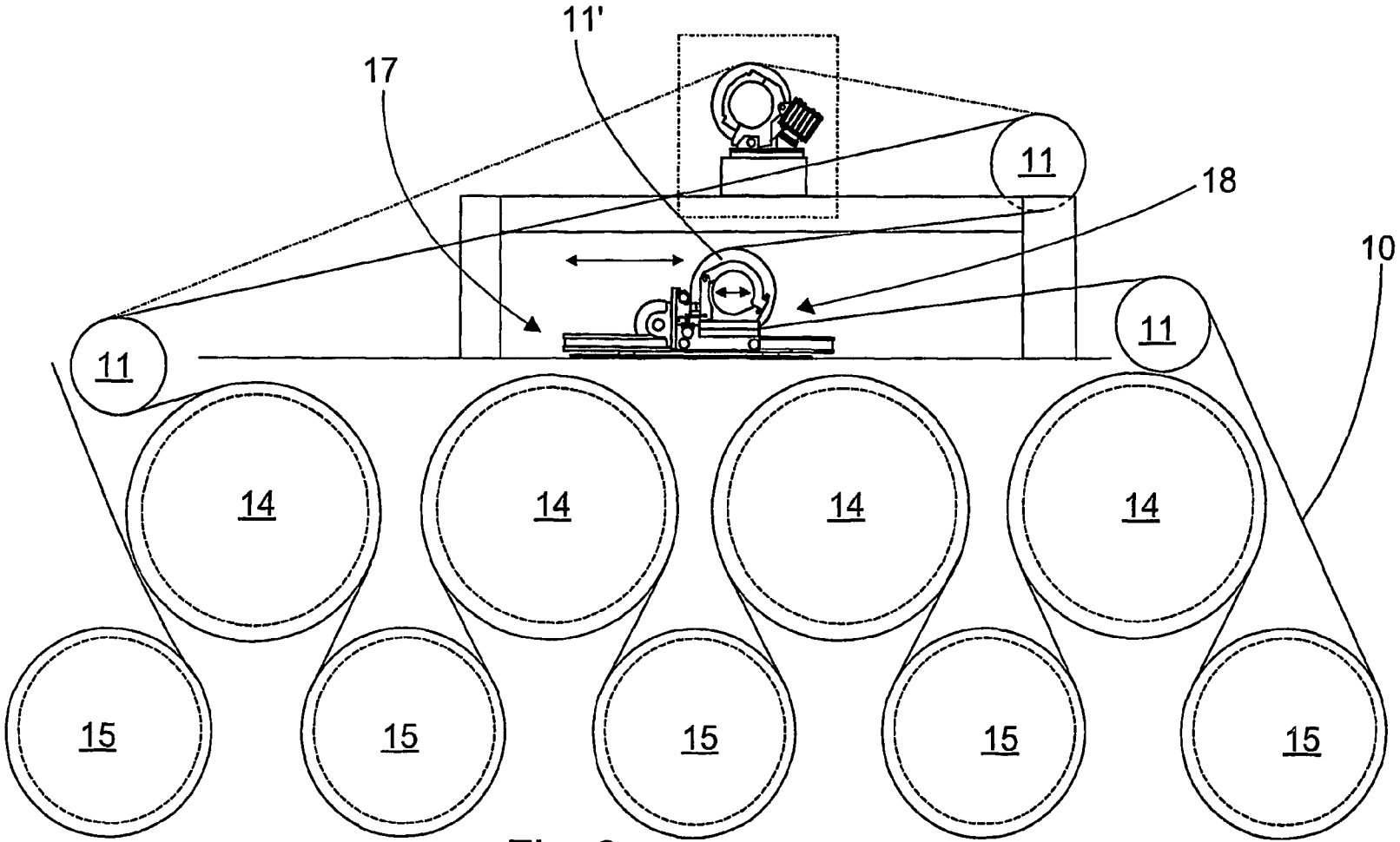
FIG. 2 shows a part of a paper machine dryer section provided with equipment according to the arrangement of the invention illustrating also a device according to the known technique.
Figure 5B:
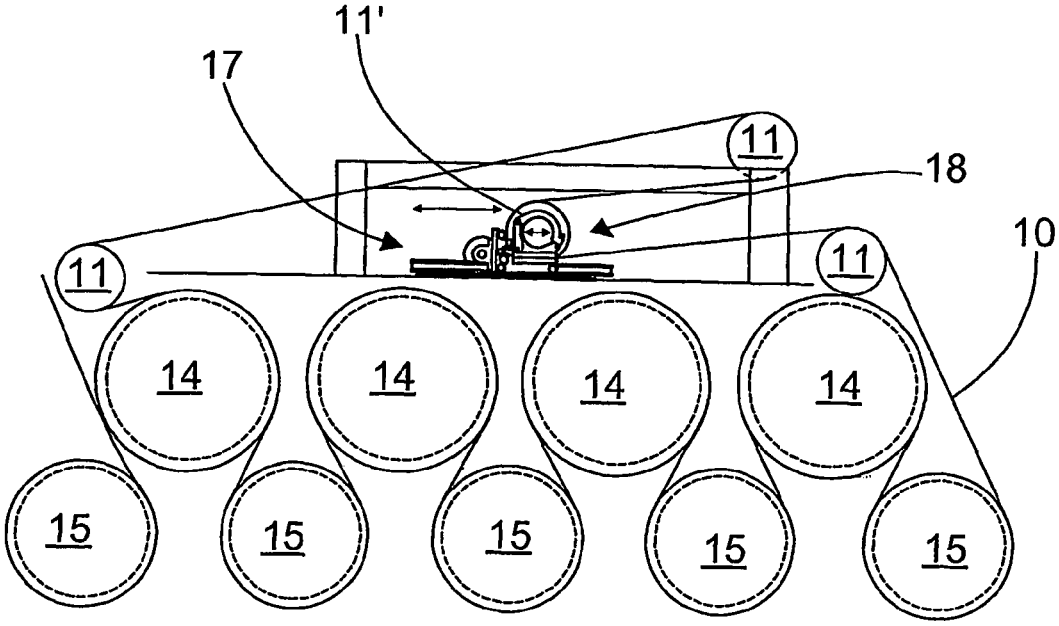
FIG. 5*b* shows the application of FIG. 2 without the device according to the known technique.

FIG. 2 shows correspondingly a part of a dryer section of a paper machine. In the known manner, the dryer section is composed of dryer groups, each of which has one dryer fabric as fabric 10. The dryer fabric runs through dryer cylinders 14 and suction cylinders 15 and via rolls 11 and 11'. Although turning of a dryer fabric is often unnecessary, the dryer groups are today also fitted with both tensioning and guiding equipment. This is illustrated by a guide roll located within the rectangle defined by the dot-and-dash line, which due to the equipment according to the invention is redundant. This kind of application is shown in FIG. 5*b*. The web (not shown) runs supported by the dryer fabric through the dryer and suction cylinders from one dryer group to the following.

In FIGS. 1 and 2 the movement directions of roll 11' are illustrated with double-headed arrows. In the press section the fabric is thus formed of a press felt comprising a guide strip. Then, arranged in the guiding equipment 18 according to the arrangement of the invention, there are two movement directions at the same time both for turning the guide strip and for guiding the press felt by changing the alignment of one roll. More explicitly, for turning the guide strip the first movement direction is arranged essentially according to the movement direction of the tensioning equipment. The movement direction of the tensioning equipment 17 is illustrated in the figures with a long double-headed arrow. Due to the parallelism, parallel guides can be used, which simplifies the equipment design. Correspondingly, for guiding the press felt the second movement direction is arranged essentially perpendicularly in relation to the wrap angle bisector of the press felt. In this way the distance travelled by the press felt remains unchanged. The wrap angle bisector is illustrated with a dot-and-dash line in FIG. 3*c*.

In a forming and dryer section of a paper or board machine the fabric 10 is composed of a wire. Then, according to the invention, arranged in the guiding equipment 18 for guiding the wire there is only one movement direction, which is adapted essentially according to the movement direction of the tensioning equipment 17. This becomes evident specifically in FIG. 2. Surprisingly, a single guiding movement provides a sufficient guiding effect for the dryer fabric.

Figures 3A, 3B, 3C:
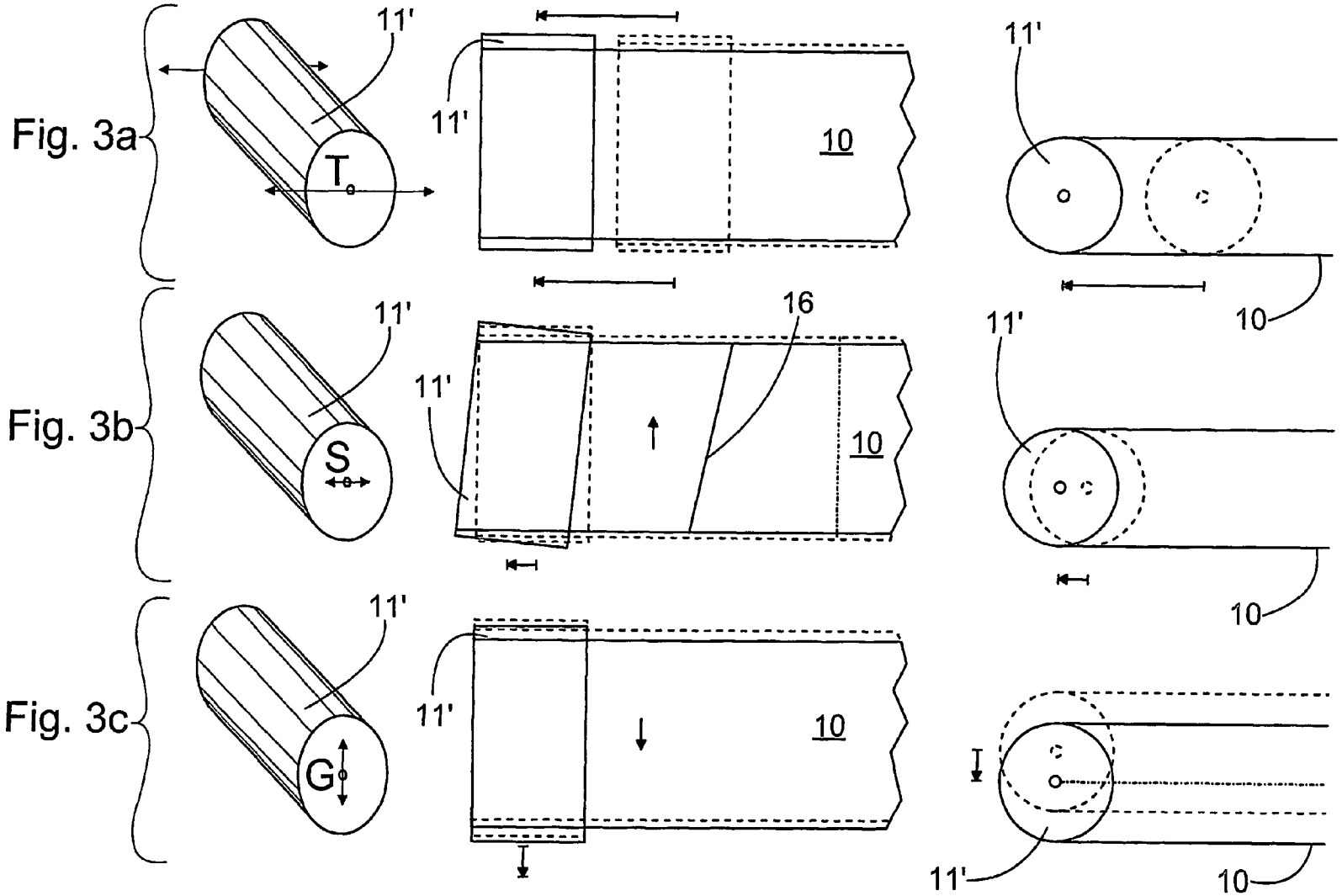
FIG. 3*a* is a drawing of a roll and its first movement direction according to the invention shown in an axonometric view and additionally from above and from the side.
FIG. 3*b* is a drawing of a roll and its second movement direction according to the invention shown in an axonometric view and additionally from above and from the side.
FIG. 3*c* is a drawing of a roll and its third movement direction according to the invention shown in an axonometric view and additionally from above and from the side.

FIGS. 3*a-c* show in detail the specific movements and movement directions of the roll 11' to be guided. In practice, all three movements can be combined in the same roll. FIG. 3*a* shows the position change of the roll 11', in which both the ends of the roll 11' are moved simultaneously and to the same extent. In this way the alignment of the roll 11' in relation to the fabric 10 remains unchanged. In other words, what is concerned is the mere tensioning, whereby the fabric remains in place in the lateral direction. In FIG. 3*a* the movement direction to be used for the tensioning adjustment is illustrated with the letter T. Along with tensioning the fabric may become slightly narrower. The roll 11' and the fabric 10, prior to moving the roll 11', are illustrated with a dot-and-dash line in FIGS. 3*a-c*.

FIG. 3*b* shows the movement direction S of the roll 11' for turning the guide strip 16, conforming thus preferably to the movement direction T of the tensioning equipment. When the roll 11' is straight, the guide strip in the fabric 10 is also straight. The guide strip in this line is illustrated with a dot-and-dash line. As shown in FIG. 3*b*, when moving the end of the roll 11' to the left, one of the edges of the fabric 10 stretches and simultaneously turns the entire fabric 10 askew. Consequently, the guide strip 16 also turns askew, which is desired. In this situation, however, the fabric 10 tends to shift towards the shorter edge, i.e. upwards in FIG. 3, which is illustrated with an arrow.

FIG. 3*c* shows the second guiding movement (movement direction G) of the roll 11' to be guided, which is preferably essentially perpendicular in relation to the previous guiding movement. In this way the second guiding movement remains pure without effect on the guide strip turning. The movement directions S and G can of course be arranged in another angle than in the right angle with respect to each other, but in that case both guiding movements will have components that are parallel with each other, which complicates the control of the equipment and makes the equipment more complicated than proposed. The second guiding movement provides a force contrary to the force caused by turning of the guide strip, making it possible to keep the fabric essentially in place in the lateral direction. In FIG. 3 the movable end of the roll 11' is being lowered.

According to the invention, the fabric wrap angle on the roll is arranged larger than 30°, which is completely new and surprising compared to the present conception. With a growing wrap angle the required roll movement reduces correspondingly, which makes the equipment particularly preferable. More precisely, according to the invention, the wrap angle is set to 80°-200°, more preferably to 170°-190°. As regards tensioning in particular, optimum is essentially a wrap angle of 180°, whereby a change in the roll position provides a maximum tensioning movement for the fabric. Deviating from the known technique, the guiding movements will function in this case, too, and the required movements are advantageously small.

Figure 4A:
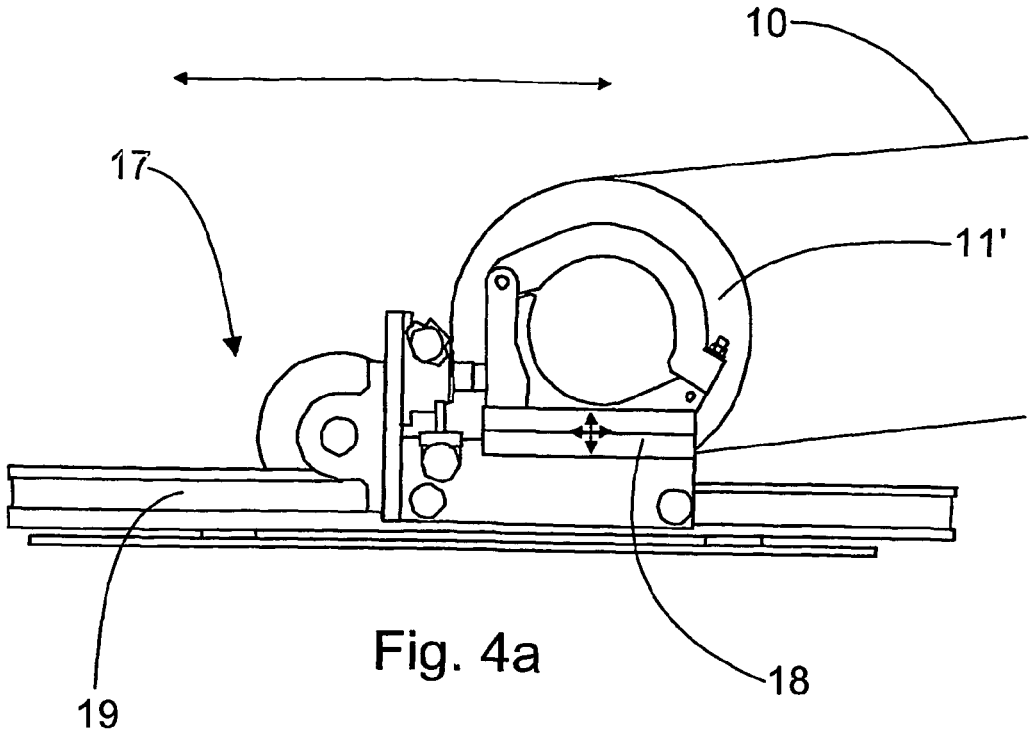
FIG. 4*a* is a side view of one piece of equipment according to the arrangement of the invention.
Figure 4B:
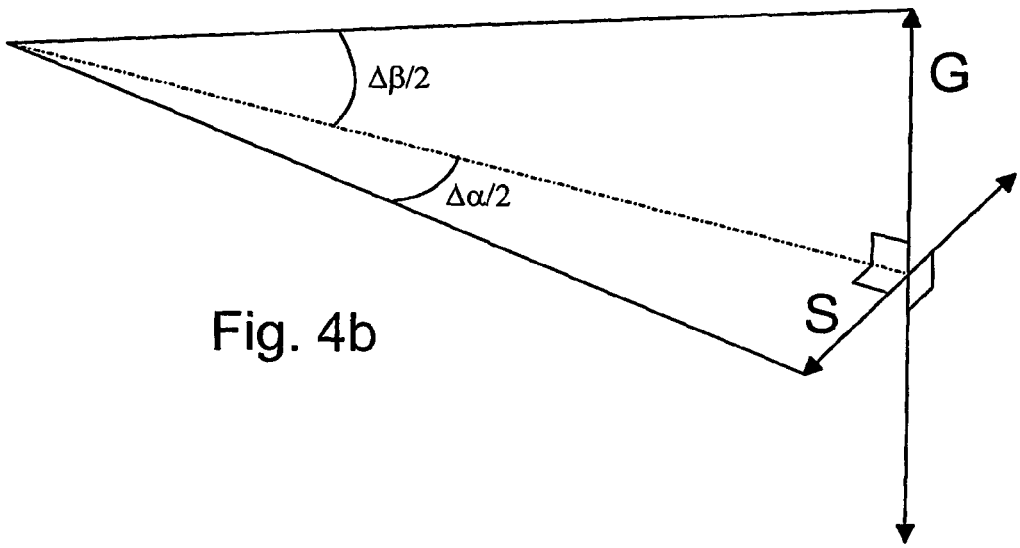
FIG. 4*b* is a drawing of movement directions and movement sizes of the roll to be guided.

FIG. 4*b* shows magnitudes of the guiding movements in principle. In the movement direction essentially conforming to the movement direction of the tensioning equipment the change in the roll alignment $\Delta\alpha$ achieved by the guiding equipment is 0.5-5°, more preferably 1-3°. That is, turning of the guide strip is provided with a very small change in the roll alignment. In the second movement direction, correspondingly, the change in the roll alignment $\Delta\beta$ achieved by the guiding equipment is 1-10°, more preferably 2-6°. Hence, in practice, a slightly bigger movement is needed for guiding, and the second guiding movement is also much smaller than conventionally. FIG. 4*b* shows the halves of the angle areas $\Delta\alpha$ and $\Delta\beta$. In addition, the movement directions S and G or at least their projections are preferably perpendicular to each other.

FIG. 4*a* shows only the equipment according to the invention, which can be freely located in various fabric runs. According to the invention, the guiding equipment 18 is arranged at the tensioning equipment 17 or between the tensioning equipment 17 and the roll 11'. In FIG. 4*a* the guiding equipment 18 is located between the roll 11' and the tensioning equipment 17. Here the tensioning equipment 17 is composed of guides 19, on which the roll 11' with the bearing assembly is adapted. The roll 11' with the guiding equipment 18 is moved on the guides 19 using suitable devices for achieving the desired tension. Correspondingly, the guiding movement or movements are provided with the guiding equipment 18, which is composed of electromechanical or hydraulic devices, for example. For example, guides or electric-motor driven worm-gear reducers can be used. Such devices are simple and easy to adjust. In addition, they provide sufficiently accurate and short guiding movements, which is a prerequisite particularly when using a large wrap angle. In practice, the movements of the roll end are only some tenths of a millimeter. However, this realizes the method according to the invention, in which the roll alignment is changed by moving one of its ends in two different movement directions. In addition, the movement directions are preferably essentially perpendicular to each other. In the figures the wrap angle is approximately 180°, in FIG. 1 even more than that.

In the tests according to the arrangement of the invention great wrap angles, exceeding 80° were used. The tests proved the functionality of the arrangement as well as the conformity of the wrap angle and the required guiding movement. With a wrap angle of 130°, for example, and a roll shift of 0.1 mm the guide strip turned 2° with a roll diameter of 500 mm and a press felt width of 2000 mm. The fabric travel was calm in other respects, too, without lateral swinging also when running the fabric to both directions.

The method according to the invention can be implemented with many different fabrics. Correspondingly, the arrangement according to the invention is simple, and remarkable savings can be achieved with it. The equipment comprised in the arrangement is compact and easy to use. As regards a paper and a board machine, a significant aspect is a calm fabric travel and control accuracy of the fabric. At the same time, the fabric life increases.

The invention claimed is:

1. A method for tensioning and guiding a fabric in a paper or board machine comprising the steps of:

supporting a fabric on spaced apart rolls to form an endless fabric loop;

tensioning and guiding the endless fabric loop wrapped about one roll of said spaced apart rolls at a wrap angle of greater than 30°, by changing the alignment and position in relation to the fabric of said one roll wherein the change in position defines a plane; and wherein the alignment of the one roll is changed by a movement of a first end of said one roll partly in the plane and partly perpendicular to the plane.

2. The method of claim 1, wherein the wrap angle is 170°-190°.

3. The method of claim 1, wherein the one roll has a first end and a second end and wherein the step of tensioning is performed by moving the first end and the second end in a first direction which defines the plane, and the step of guiding is performed by moving the first end in the first direction in the plane and in a direction perpendicular to the first direction.

4. An apparatus for tensioning and guiding a fabric in a paper or board machine, comprising:

a fabric arranged as an endless loop supported on rolls for motion, wherein one roll of said rolls is connected to tensioning equipment, the tensioning equipment arranged for tensioning the fabric by changing the position in a first direction of both a first end and a second end of said one roll in relation to the fabric without changing the alignment of said one roll in relation to the fabric, and the rolls are so arranged that a wrap angle of the fabric at the one roll connected to the tensioning equipment is greater than 30°; and wherein said one roll is connected to guiding equipment mounted for changing the position of the first end in a guiding movement in a second direction and mounted for changing the position of the first end in a guiding movement in a third direction, the second movement direction and the third movement direction being such as to cause motion of the first end roll to move in two perpendicular directions for guiding the fabric by changing the alignment of said one roll in relation to the fabric by changing the position of the first end of said one roll in relation to the fabric without changing the position of the second end of said one roll.

5. The apparatus of claim 4, wherein the guiding equipment is arranged at the tensioning equipment.

6. The apparatus of claim 4, wherein the guiding equipment is arranged between the tensioning equipment and the one roll.

7. The apparatus of claim 4, further comprising a press section of a paper or board machine, in which the fabric is composed of a press felt having a guide strip and defining a travel distance about the rolls, and wherein the guiding equipment is arranged to move the first end in the second direction and in the third direction simultaneously, to turn the guide strip and to guide the fabric.

8. The apparatus of claim 4, wherein the guiding equipment is arranged so that the second direction is arranged essentially conforming to the first direction of the tensioning equipment.

9. The apparatus of claim 8, wherein the guiding equipment is arranged so that the third direction is arranged essentially perpendicular in relation to a wrap angle bisector of the fabric so that the travel distance remains unchanged.

10. The apparatus of claim 4, wherein the one roll which is connected to guiding equipment defines a range of movement within an alignment angle $\Delta\alpha$ with respect to a cross machine direction provided by the guiding equipment in the second direction, wherein the second direction essentially conforms to the first direction, the alignment angle $\Delta\alpha$ being 0.5-5°.

11. The apparatus of claim 4, wherein the one roll which is connected to guiding equipment defines a range of movement within an alignment angle $\Delta\alpha$ with respect to a cross machine direction provided by the guiding equipment in the second direction, wherein the second direction essentially conforms to the first direction, the alignment angle $\Delta\alpha$ being 1-3°.

12. The apparatus of claim 11, wherein the one roll which is connected to guiding equipment further defines a range of movement within an alignment angle $\Delta\beta$ of 1-10° provided by the guiding equipment in the third direction and perpendicular to the second direction.

13. The apparatus of claim 11, wherein the one roll which is connected to guiding equipment further defines a range of movement within an alignment angle $\Delta\beta$ of 2-6° provided by the guiding equipment in the third direction and perpendicular to the second direction.

14. Equipment for tensioning and guiding a fabric in a paper or board machine, comprising:

a fabric arranged as an endless loop supported on rolls for movement;

tensioning equipment connected to one roll of said rolls, and arranged to apply tensioning to the fabric by movement in relation to the fabric of both of a first end and a second end of the one roll of said rolls without changing the alignment of the one roll in relation to the fabric, so the movement defines a plane;

wherein the rolls are so arranged that a wrap angle of the fabric about the one roll is greater than 30°;

guiding equipment mounted for changing the position of the first end of said one roll in a guiding movement in the plane, and the guiding equipment mounted for changing the position of the first end of said one roll in a guiding movement in a direction perpendicular to the plane, so as to cause the first end of said one roll to move in two perpendicular directions, the guiding equipment connected to the one roll for guiding the fabric by changing the alignment of the one roll of said rolls in relation to the fabric by changing the position of the first end of the roll in relation to the fabric without changing the position of the second end of the roll; and wherein the tensioning equipment and the guiding equipment are arranged to both tension and guide the fabric by changing the alignment and position of the one roll in relation to the fabric.

15. The equipment of claim 14, wherein the first movement direction is arranged to turn a guide strip of the fabric by changing the alignment of the one roll, the first movement direction being essentially perpendicular to the second movement direction.

16. The equipment of claim 14, wherein the wrap angle is 80°-200°.

17. The equipment of claim 14, wherein the wrap angle is 170°-190°.

* * * * *